US005481958A

United States Patent [19]

Balbo et al.

[11] Patent Number: 5,481,958

[45] Date of Patent: Jan. 9, 1996

[54] WEAPON WITH A MOBILE BREECH BLOCK

[75] Inventors: Patrick Balbo; Jean-Pierre Brauge, both of Bourges, France

[73] Assignee: Giat Industries, France

[21] Appl. No.: 352,100

[22] Filed: Nov. 30, 1994

[30] Foreign Application Priority Data

Dec. 7, 1993 [FR] France ..... 93 14633

[51] Int. Cl.[6] ..... F41A 9/38

[52] U.S. Cl. ..... 89/45; 89/24

[58] Field of Search ..... 89/22, 23, 24, 89/25, 45, 46, 47

[56] References Cited

U.S. PATENT DOCUMENTS 4,986,162 1/1991 Wissing ..... 89/24

FOREIGN PATENT DOCUMENTS 944047 3/1949 France .
2639426 5/1990 France .
667719 10/1988 Switzerland .

*Primary Examiner*—Stephen C. Bentley
*Attorney, Agent, or Firm*—Parkhurst, Wendel & Rossi

[57] ABSTRACT

A weapon (10) includes a breech block (12) moving between a closed position in which breech block (12) seals off a chamber (17) and an open position in which chamber (17) is open to receive ammunition from a loading tube (13).

The means forming lock (16) is designed to hold breech block (12) open and unlocking means (14) is adapted to bring the means forming lock (16) into the unlocked position when loading tube (13) is moved away from chamber (17), and is mounted on loading tube (13).

10 Claims, 3 Drawing Sheets

WEAPON WITH A MOBILE BREECH BLOCK

BACKGROUND OF THE INVENTION

The present invention concerns a weapon with a breech block movable between a closed position, in which the breech block closes off an ammunition chamber and an open position in which the chamber is open to receive ammunition.

The weapons concerned by the present invention are preferably large caliber artillery weapons including a sleeve breech and a breech block which can slide in the sleeve.

In known embodiments of the weapons, the installation of ammunition in the weapon chamber uses a ram to push the ammunition into the top part of the case.

The ram, pushing the ammunition along a direction oblique to the chamber and its opening axis means that users often have difficulties in placing the ammunition and of jamming the weapon.

In addition, in the weapons used today, ammunition is fed by a loading tube which is placed next to the sleeve of the weapon.

Therefore, the ammunition is not fed into the entrance of the ammunition chamber.

SUMMARY OF THE INVENTION

The present invention is designed to solve the aforementioned problems by proposing a weapon allowing easier installation of the ammunition while offering greater safety upon loading.

The weapon concerned by this invention includes a breech block movable between a closed position in which the breech block seals off an ammunition chamber, and an open position in which the chamber is open to receive ammunition from a loading tube.

According to the invention, the means forming the lock is designed to maintain the breech block in the open position and unlocking means designed to place the facilities forming the lock in the unlocked position when the loading tube is moved away from the ammunition chamber and are mounted on the loading tube.

Thus, thanks to this invention, the breech block is released by the loading tube only when it is moved away from the ammunition chamber, after the insertion of the ammunition.

Therefore, a central ram can be used to push the ammunition in line with the opening of the weapon ammunition chamber.

In a preferred embodiment of the invention, the means forming a lock apply a locking force more or less opposed to a return force applied to the breech block by flexible return means that is adapted to move said breech block from the open position to the closed position.

Thus, as soon as the means forming the lock is placed in the unlocked position, the breech block is brought back to its closed position by a flexible return device.

According to a preferred embodiment, the loading tube is suitable for being positioned adjacent to the ammunition chamber.

The ammunition is thus eased into position as the loading tube advances to the chamber entry level.

Other particularities and advantages of the invention will appear in the following description.

BRIEF DESCRIPTION OF THE DRAWING

In the attached illustrations, given as non-limitative examples.

DETAILED DESCRIPTION OF THE PREFERRED EMBODIMENTS

Figure 1:
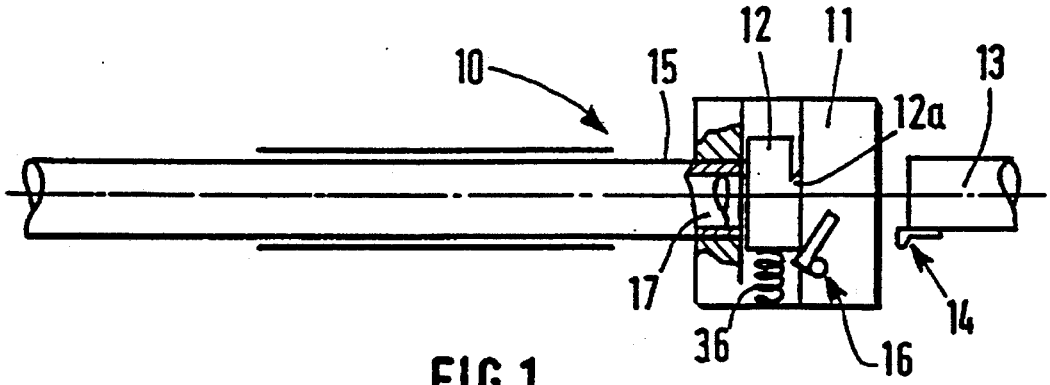
FIG. 1 is a general view illustrating a weapon according to the invention.

With reference firstly to FIG. 1, weapon 10 referred to in this invention includes a breech block 12 moving between a closed position in which breech block 12 seals off a chamber 17 in an end of barrel 15 and an open position in which the chamber 17 is open to receive ammunition from a loading tube 13.

Breech block 12 can slide within a sleeve 11 arranged on the rear side of weapon 10.

Chamber 17 is located just behind of artillery barrel 15.

In accordance with this invention, the means forming lock 16 is adapted to maintain the breech block 12 in the open position and unlocking means 14 is suitable for placing the means forming the lock 16 in the unlocked position when loading tube 13 is moved away from chamber 17. Unlocking means 14 is mounted on loading tube 13.

Figure 2:
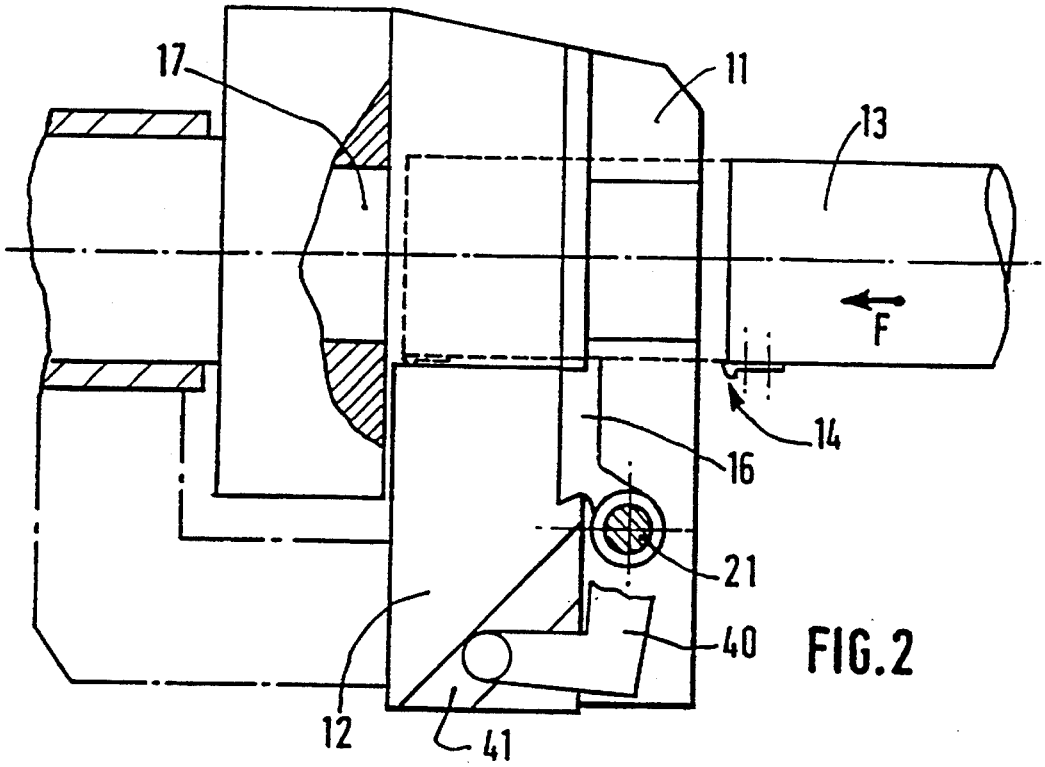
FIG. 2 is a partial sectional view of the breech in the locked position.
Figure 3:
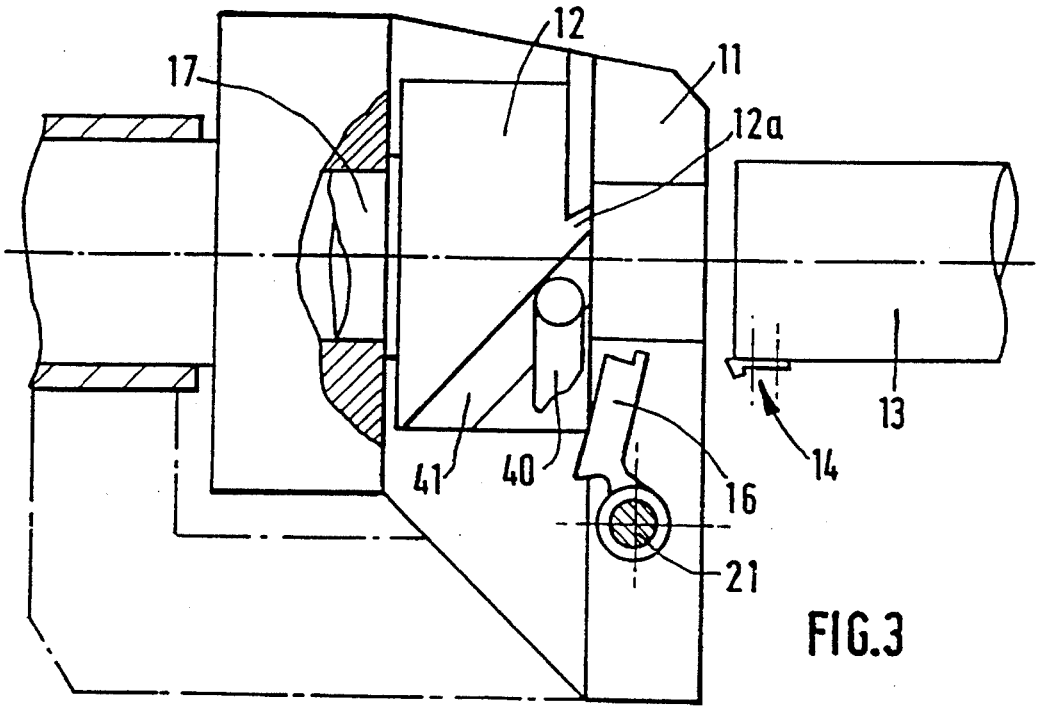
FIG. 3 is a similar view to FIG. 2 of the breech in the unlocked position.

As illustrated in FIGS. 2 and 3, breech block 12 is opened by an arming lever 40, one end of which is engaged in a housing 41 in the breech block 12, preferably near its base.

The movement imparted to the arming lever 40 is by a known means on entry of the weapon into the battery after firing by a cam and support cam plate system not shown in the figures.

The means forming lock 16 applies a locking force more or less opposing the return force applied to breech block 12 by flexible return means 36 designed to move breech block 12 from the open position to the closed position.

As shown in FIG. 1, the flexible return means 36 could be a spring operating by compression.

In the described production example, the locking force is applied directly to breech block 12, preferably near the bottom part of the breech block.

As clearly illustrated in FIG. 2, on loading, the breech block 12 is in the open position and loading tube 13 is inserted (in the direction of arrow F) into weapon 10, inside sleeve 11, and is placed adjacent to chamber 17 (see the dotted line position in FIG. 2).

Automatic loading tube 13 thus comes into contact with chamber 17 and a central ram (not shown) brings the ammunition into position in the chamber.

The ammunition is held in position inside chamber 17 thanks to a retracting stop, not shown, clearly described in French patent publication No. 2611260.

Loading tube 13 is therefore placed above breech block 12 on the loading weapon 10.

The means forming lock 16 and the unlocking means 14 are designed to retract with respect to one another when loading tube 13 is moved towards chamber 17 (i.e., when it passes above breech block 12), and come into contact with one another either when loading tube 13 is moved away from chamber 17 so that the means forming lock 16 is unlocked.

Figure 6:
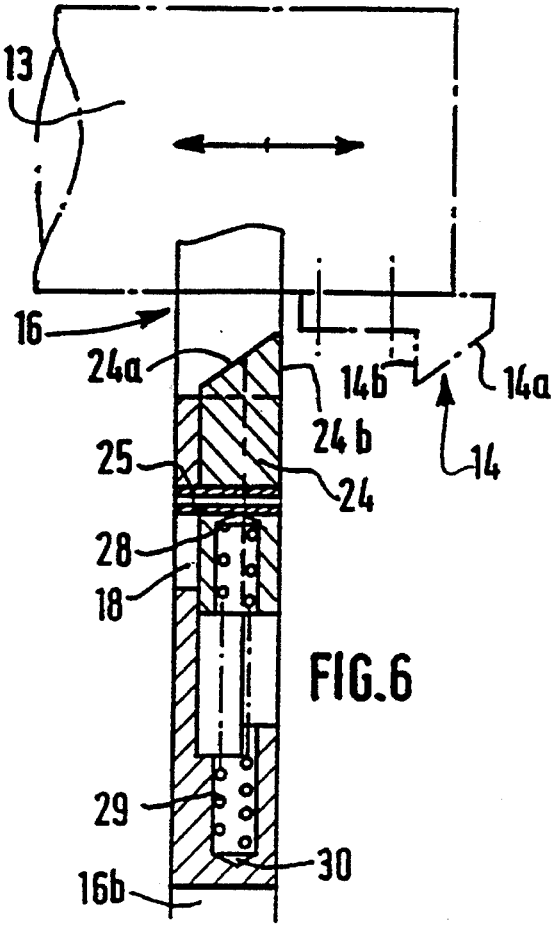
FIG. 6 is a sectional view of a retracting device and an unlocking device in accordance with the invention.
Figure 7:
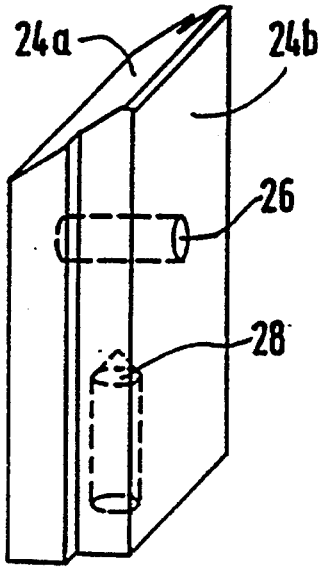
FIG. 7 is a perspective view of the retracting device of FIG. 6.
Figure 8:
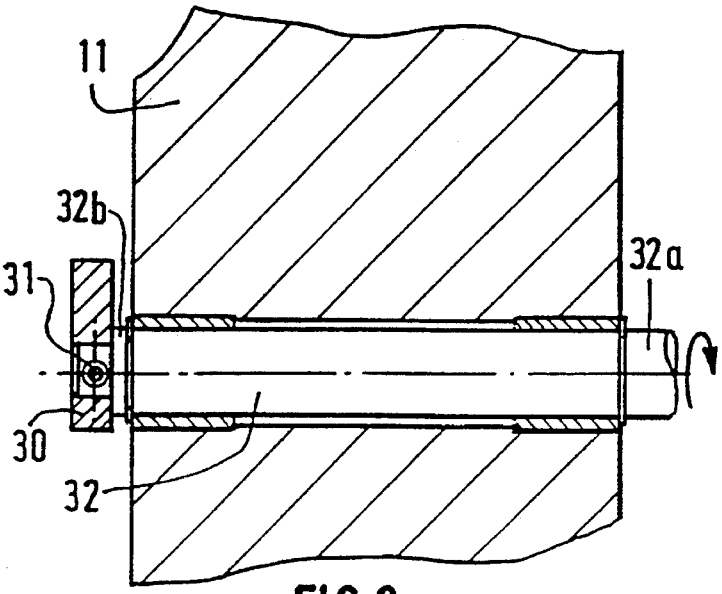
FIG. 8 is a transverse sectional view of the weapon showing a manual unlocking device.

As shown in FIG. 6, the means forming lock 16 includes a retracting device 24 designed to slide between a protruding position and a retracted position while a flexible return means 29 is adapted to return retracting device 24 to a protruding position.

Retracting device 24 includes at its protruding end a surface 24*a* forming an externally inclined facet of weapon 10 and a surface 24*b* more or less vertical and directed towards the inside of weapon 10.

In a complementary manner, unlocking means 14 comprises an elongated element in the form of a pin one end of which includes surfaces 14*a* and 14*b* in compliance with surfaces 24*a* and 24*b* of retracting device 24.

Thus, surface 14*a* is inclined in the same way as surface 24*a* of device 24 in such a way that when these two surfaces 14*a* and 24*a* are in contact, when loading tube 13 moves towards chamber 17, surface 14*a* retracts device 24.

Figure 4:
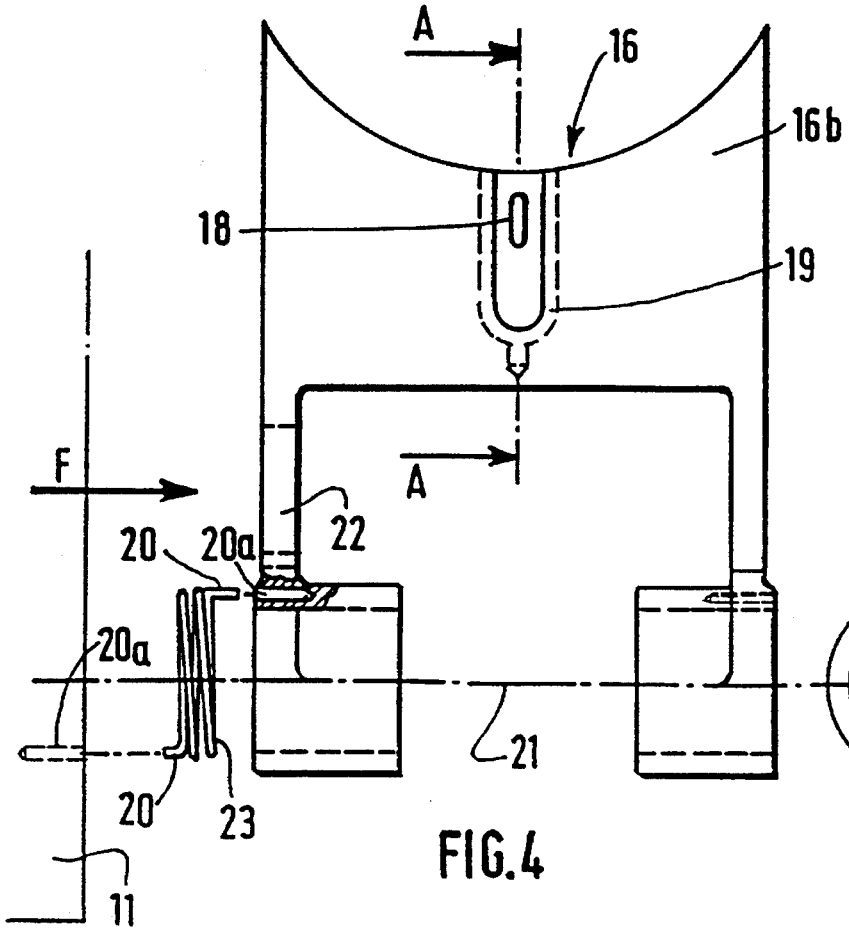
FIG. 4 is a front view of a locking device.
Figure 5:
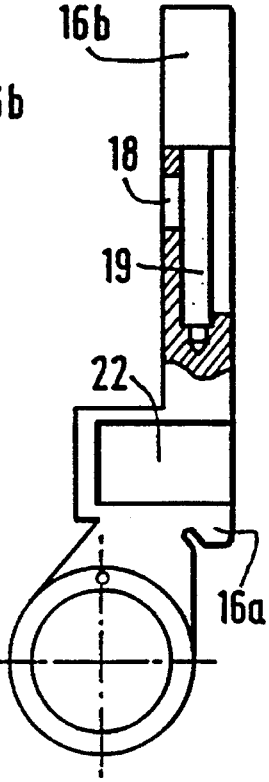
FIG. 5 is a view along F on a partial section A—A of FIG. 4.

Retracting device 24 can slide by translation within body 16*b* of the facility forming a lock 16 in groove 19, Tee-shaped as illustrated in FIGS. 4 and 5.

Flexible return means 29 of device 24 is a spring placed between two housings 28 and 30 pierced respectively inside retracting device 24 and body 16*b* of the means forming a lock 16.

The retracting device, moved by the return force applied by spring 29, is stopped in its translation movement by a split pin 25 mounted in a hole 26 passing through retracting device which moves inside a hole 18 provided in body 16*b*, parallel to the direction of translational movement of the retracting device and which abuts at the upper end of this hole 18.

Conversely, surface 14*b* of unlocking means 14 is more or less vertical and therefore engages with corresponding surface 24*b* of retracting device 24 when loading tube 13 protrudes from weapon 10 as it moves away from chamber 17.

The means forming lock 16 is mounted to swivel on an axis of rotation 21 between a locked position and an unlocked position. This arrangement is shown in FIGS. 4 and 5.

When surface 14*b* of unlocking means 14 meshes with retracting device 24, the means forming lock 16 is driven to rotate about axis 21.

The means forming lock 16 includes a locking hook 16*a* adapted to mesh with a means forming a stud 12*a* integral with breech block 12.

Preferably, body 16*b* includes two locking hooks 16*a* which lock the breech block 12 by applying force opposing the return force applied by spring 36 at two points of breech block 12, at the two side ends of that block.

When unlocking means 14 abuts retracting device 24, the means forming lock 16 swivels about the axis of rotation 21 thus releasing studs 12*a* of breech block 12 from locking hooks 16*a*.

Breech block 12 can therefore close to cover chamber 17 while the energy required for this movement comes from spring 36.

In addition, two torsion springs 23 are designed to return the means forming lock 16 into its locked position.

These torsion springs are located on either side of body 16*b* of the means forming lock 16. They are aligned with axis of rotation 21 and each is arranged between body 16*b* and sleeve 11 of weapon 10.

Housings 20*a* are placed respectively in sleeve 11 and body 16*b* of the locking means in order to receive ends 20 of the torsion springs.

Accordingly, when breech block 12 is brought to the open position by arming lever 40, torsion spring 23 automatically places the locking hooks 16*a* to engage with studs 12*a* of the breech block while tilting the means forming lock 16 about axis of rotation 21.

Preferably, arming lever 40 is also mounted at the end opposite to the end integral with breech block 12 on axis of rotation 21.

Preferably, weapon 10 also includes a manual unlocking device including a shaft 32 mounted to rotate on weapon 10 and having one end 32*a* outside the weapon 10 and a second end 32*b* integral with a cam 30, which cam 30 is adapted to place the means forming lock 16 in an unlocked position.

Unlocking is controlled by an opening lever (not shown) located outside of sleeve 11 of weapon 10 and integral with end 32*a* of shaft 32 so as to be within reach of the gunner's hand.

Cam 30 is connected to shaft 32 by a spring pin 31 in such a way that the rotation of the lever is transmitted to cam 31.

This cam 31 is more or less oval in shape and is housed inside a recess 22 in body 12*b* of the device forming lock 16.

Figure 9:
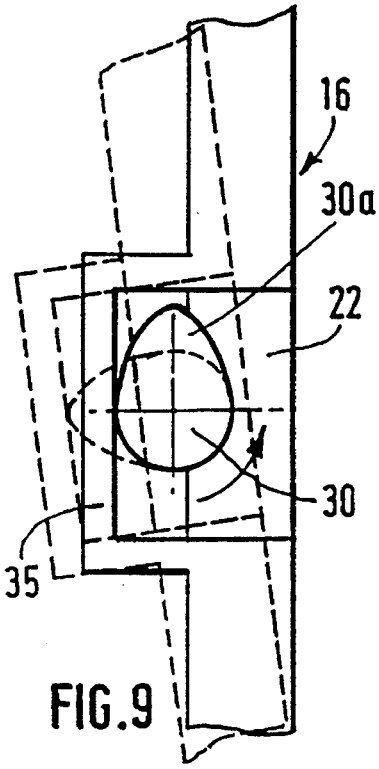
FIG. 9 is a schematic view illustrating the operation of the manual unlocking device of FIG. 8.

The arrangement of this cam 31 in housing 22 is of such a type that when the means forming lock 16 is locked, as shown in FIG. 9 by solid lines, the cam is adjacent to or near a wall of housing 22 at a point near its axis of rotation.

When the cam is driven in rotation, a portion of cam 30, farther from its axis of rotation than the remainder of the cam, i.e. comprising part of tip 30*a* and oval cam 30, comes into contact with a wall of housing 22 thus applying force to all of the means forming lock 16. Lock 16 is then moved to swivel about the axis of rotation 21 against the action of return spring 23 in such a way as to release locking hooks 16*a* from studs 12*a* on breech block 12. The breech block 12 is then unlocked and rises to the closed position to seal off chamber 17.

Naturally, the invention is not limited to the above example and many modifications can be made without moving out of the scope of this invention.

Accordingly, it is possible to lock the breech block on the top section instead of the bottom section.

The means forming a lock could be applied directly to the spring closing the breech block while unlocking means could work upon the means forming the lock so as to release, by a mechanical arrangement, the energy contained in the breech block closing spring.

We claim:

1. A weapon, comprising:

a chamber in one end of a barrel, said chamber having an open end;

a loading tube for loading ammunition into said chamber through said open end;

a breech block provided at said open end of the chamber, said breech block being movable between open and closed positions, whereby in said open position said breech block permits loading of said chamber;

a lock for locking said breech block in the open position; and a unlocking means for unlocking the breech block when said loading tube is retracted from said chamber, thereby allowing said breech block to move to said closed position, said unlocking means being mounted on said loading tube.

2. The weapon of claim 1, further comprising return means for applying a return force to said breech block to bias said breech block from said open position to said closed position, wherein said lock is adapted to apply a locking force to said breech block substantially opposite said return force.

3. The weapon of claim 2, wherein said lock directly applies the locking force to said breech block.

4. The weapon of claim 1, wherein said loading tube is adapted to be positioned adjacent said chamber.

5. The weapon of claim 1, wherein the lock and said unlocking means are adapted to retract from each other when the loading tube is moved toward the chamber, and abut one another when the loading tube is retracted from the chamber thereby unlocking the breech block.

6. The weapon of claim 5, wherein the lock includes a retracting device slidable between a protruding position and a retracted position, and a biasing means for biasing said retracting device toward said protruding position.

7. The weapon of claim 1, wherein the lock is pivotally mounted on an axis of rotation, said lock being pivotal between locked and unlocked positions.

8. The weapon of claim 7, further comprising at least one torsion spring for biasing the lock to the locked position.

9. The weapon of claim 1, wherein the lock comprises a locking hook, the breech block comprises a complementary stud, and the locking hook is adapted to abut said complementary stud to lock the breech block in the open position.

10. The weapon of claim 1, further comprising a manual unlocking device including a shaft having first and second ends, a cam secured to said first end of the shaft, said second end extending from the weapon, wherein the cam engages the lock to force the lock to an unlocked position upon manual rotation of said shaft.

* * * * *